US006006729A

United States Patent [19]

Aoyama

[11] Patent Number: 6,006,729

[45] Date of Patent: Dec. 28, 1999

[54] FUEL PIPING STRUCTURE IN A LONGITUDINAL ENGINE

[75] Inventor: Shigeru Aoyama, Shizuoka-ken, Japan

[73] Assignee: Suzuki Motor Corporation, Shizuoka-ken, Japan

[21] Appl. No.: 09/037,364

[22] Filed: Mar. 10, 1998

[30] Foreign Application Priority Data

Mar. 31, 1997 [JP] Japan ..... 9-096741

[51] Int. Cl.[6] ..... F02M 15/00; F02M 55/02

[52] U.S. Cl. ..... 123/541; 123/514; 123/468

[58] Field of Search ..... 123/456, 468, 123/469, 514, 541, 41.31, 54.4

[56] References Cited

U.S. PATENT DOCUMENTS

| | | | |
|---|---|---|---|
| 2,120,779 | 6/1938 | Ericson | 123/541 |
| 4,072,138 | 2/1978 | Hawkins et al. | 123/541 |
| 4,870,828 | 10/1989 | Hidaka et al. | 123/541 |
| 4,872,438 | 10/1989 | Ausiello et al. | 123/514 |
| 4,875,439 | 10/1989 | Widmer et al. | 123/541 |
| 4,915,063 | 4/1990 | Stumpf | 123/41.31 |
| 4,924,838 | 5/1990 | McCandless | 123/514 |
| 5,118,451 | 6/1992 | Lambert, Sr. et al. | 123/557 |
| 5,197,436 | 3/1993 | Ozawa | 123/468 |
| 5,367,998 | 11/1994 | Shiohara et al. | 123/54.4 |

FOREIGN PATENT DOCUMENTS 8-334032 12/1996 Japan .

*Primary Examiner*—Thomas N. Moulis
*Attorney, Agent, or Firm*—Flynn, Thiel, Boutell & Tanis, P.C.

[57] ABSTRACT

An engine is mounted in an engine compartment of a vehicle, and a cooling fan driven directly by the engine is disposed on the front of the engine. A fuel piping structure is located between an exhaust manifold and the cooling fan so that air from the fan passes over and cools the fuel piping structure, and carries the heat of the exhaust manifold rearwardly away from the fuel piping structure.

13 Claims, 4 Drawing Sheets

FUEL PIPING STRUCTURE IN A LONGITUDINAL ENGINE

FIELD OF THE INVENTION

The present invention relates to a fuel piping system for a vehicle and, more particularly, to an improved fuel piping system which is not significantly affected by the heat of exhaust components, is capable of preventing overheating of the fuel, is capable of integration with the coolant piping, decreases the number of mounting steps, and reduces the number of parts.

BACKGROUND OF THE INVENTION

Motor vehicles have fuel piping systems for the supply of fuel from a fuel tank to an engine mounted in an engine compartment. For example, a conventional fuel piping system is shown in FIG. 7, in which numeral 102 denotes a vehicle, 104 denotes a frame, 106 a side member of the frame, and 108 a cross member of the frame. One side member 106 is disposed on each side of the vehicle in the longitudinal direction thereof. The sidewardly spaced side members 106 are connected together by the transversely-extending cross member 108 which is disposed below an engine compartment 110 and is located at the front of the vehicle in the longitudinal direction thereof. In FIG. 7 there is illustrated a single side member 106 located on one side of the vehicle.

In the engine compartment 110 there is mounted a conventional engine 112 aligned in the vehicular longitudinal direction. In the engine 112, as shown in FIGS. 5 and 6, cylinder banks 114A and 114B are disposed in a V shape, exhaust manifolds 116A and 116B as components of an exhaust system are disposed on both sides in the transverse direction, and in a transversely-extending middle region are disposed, as components of a fuel system, delivery pipes 118A and 118B in a right and left relation to each other, fuel injection valves 120A and 120B also in a right and left relation, and a fuel pressure regulating valve 122.

As shown in FIG. 7, the vehicle 102 has a fuel tank 124 mounted on the rear side in the vehicular longitudinal direction. The fuel tank 124 is provided with a fuel pump 126. The engine 112 is connected to the fuel tank 124 through a conventional fuel piping system 128. The fuel piping system 128 for the engine 112 connects the fuel pump 126 to the delivery pipes 118A and 118B through a tank-side fuel supply hose 130, a fuel supply pipe 132 and an engine-side fuel supply hose 134. A fuel filter 136 in the middle of the tank-side fuel supply hose 126 is disposed.

The fuel piping system 128 connects the fuel pressure regulating valve 122 to the fuel tank 124 through an engine-side fuel return hose 138, a fuel return pipe 140 and a tank-side fuel return hose 142.

The fuel piping system 128, including the engine-side fuel supply hose 134 and fuel-return hose 138, which are located in close proximity to the engine 112, are disposed to extend from the front toward the back of engine 112 while detouring above exhaust manifold 116A (FIG. 5), or alternatively are disposed on the rear side of the manifold 116A (FIG. 6).

Such a fuel piping system in an engine is disclosed, for example, in Japanese Patent Laid Open No. 8-334032. According to the fuel piping system disclosed therein, a fuel damper is disposed near the front end of a cylinder bank of a V-type internal combustion engine mounted longitudinally on a vehicle and between the cylinder bank and the inner wall of an engine compartment, and a fuel piping connected from the fuel tank to the fuel damper is disposed to the front side while detouring above the exhaust manifold.

In a conventional arrangement wherein an in-line type engine extends longitudinally of the vehicle, intake components such as an intake manifold are disposed on one side of the engine in the transverse direction, while exhaust components such as an exhaust manifold are disposed on the other side of the engine in the transverse direction. In a fuel piping structure of such a longitudinally-oriented engine, fuel piping is laid on the side of the engine opposite to the side where exhaust components are disposed to protect the fuel piping from the exhaust heat.

In a conventional V-type longitudinally-oriented engine 112, however, intake components are disposed in the middle of the engine (i.e., between the cylinder banks) and exhaust components are disposed on both outer sides of the engine in the transverse direction. In such a V-type engine, therefore, the fuel piping structure 128 is conventionally disposed on the front side of the engine while detouring above the exhaust manifold 116A as shown in FIG. 5, or is disposed on the rear side of the manifold 116A as shown in FIG. 6.

In this case, to protect the fuel piping structure 128 from the heat of the exhaust manifold 116A, it is necessary to provide a sufficient clearance from the exhaust manifold 116A and to cover the fuel piping with a shield member such as a heat protector (not shown). In such a fuel piping structure, however, due to limited space in the engine compartment 110, it is sometimes difficult to provide a sufficient clearance as mentioned above, and using a heat protector increases the number of parts and the number of mounting steps, which causes an increase in the cost of the vehicle.

SUMMARY OF THE INVENTION

To alleviate the above-mentioned inconveniences, the present invention relates to an engine which is mounted in an engine compartment with its length axis aligned with the vehicle longitudinal direction, a cooling fan is disposed on the front side of the longitudinally-oriented engine, the cooling fan being driven directly by the engine, and a fuel piping structure is positioned between an exhaust component of the engine and the cooling fan. The invention further preferably has the fuel piping structure integral with a coolant piping structure which is positioned between the exhaust component of the engine and the cooling fan. With this arrangement, the heat of the exhaust component can be transferred backwardly from the engine by the air flowing from the cooling fan, and thus the influence of heat on the fuel piping structure is eliminated or minimized.

Further, in the fuel piping structure according to the present invention, a coolant piping structure is positioned between the exhaust component of the engine and the cooling fan, and the fuel piping structure is made integral with the coolant piping. With this arrangement, the fuel can be cooled by coolant flowing through the coolant piping, and by the integral structure of the fuel piping and the coolant piping, and both piping structures can be supplied as a common unit.

DETAILED DESCRIPTION

An embodiment of the present invention will be described with reference to FIGS. 1 to 4.

Figure 3:
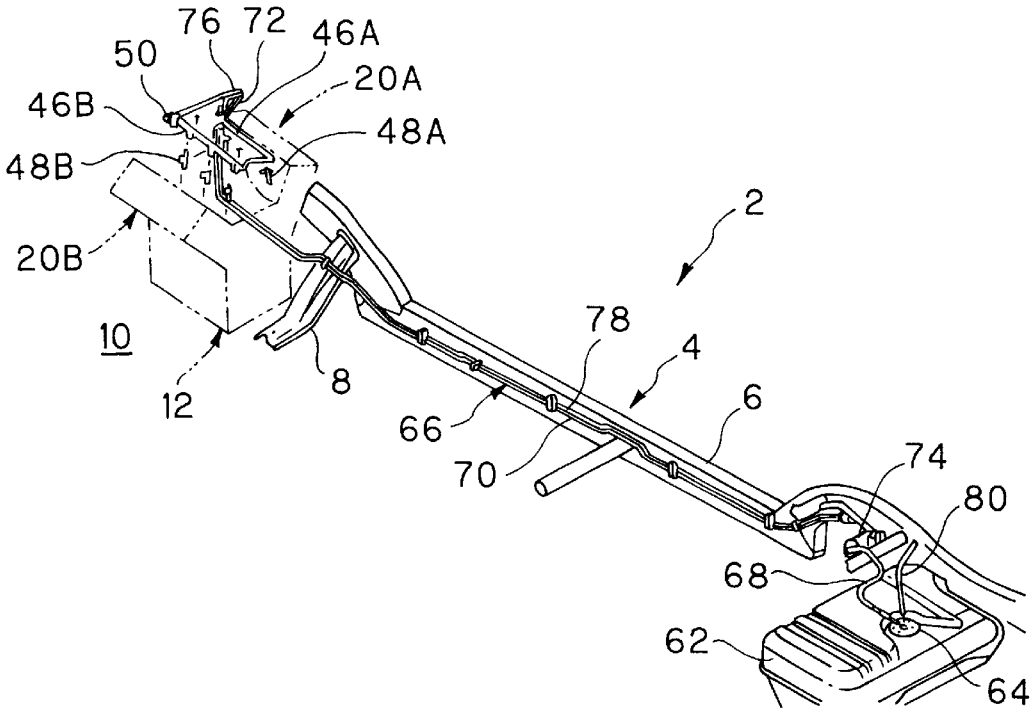
FIG. 3 is a perspective view showing the fuel pipes running between the engine and the fuel tank.

In FIG. 3, reference numeral 2 denotes a vehicle, 4 denotes a frame, 6 denotes a side member, and 8 denotes a cross member. In the frame 4 of the vehicle 2, side members 6 are disposed adjacent opposite sides of the vehicle and extend in the longitudinal direction thereof, and are sidewardly connected together through the cross member 8 which is located on the front of the vehicle 2 and positioned below the engine compartment 10. In FIG. 3 there is illustrated a single side member 6 located on one side of the vehicle.

Figure 1:
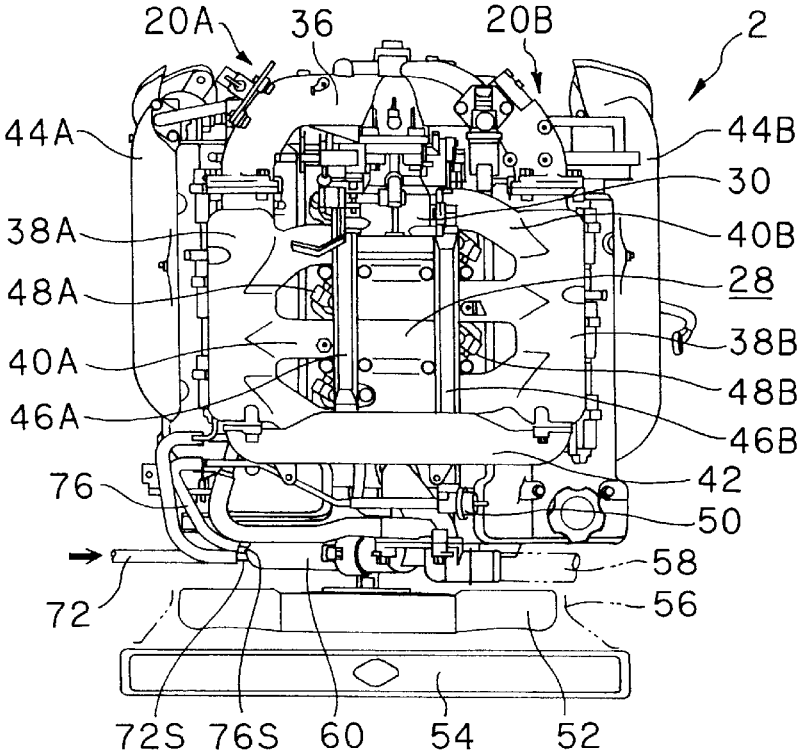
FIG. 1 is a plan view of an engine showing a fuel piping structure according to an embodiment of the present invention.
Figure 2:
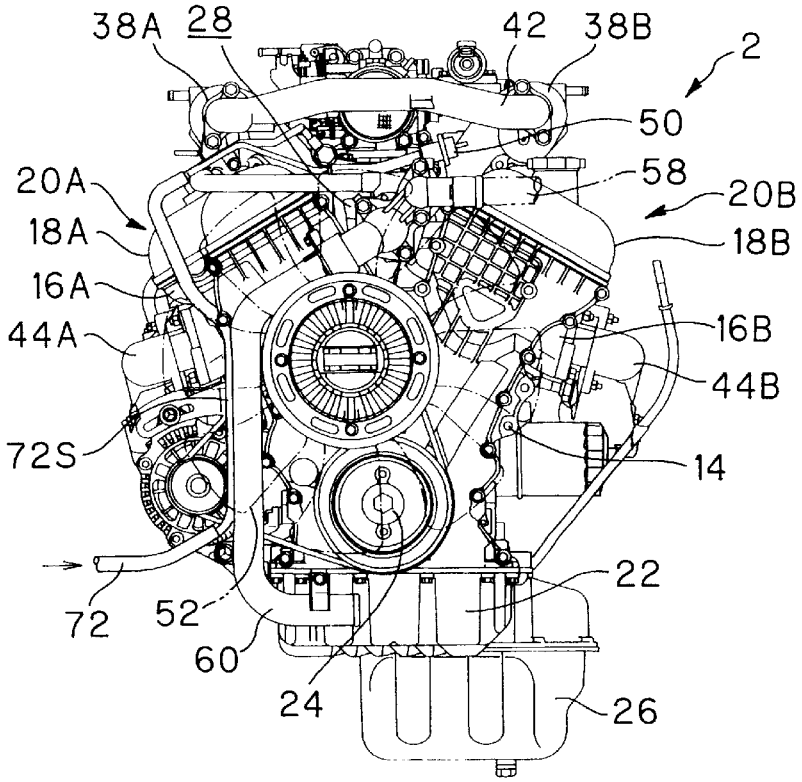
FIG. 2 is a front view of the engine of FIG. 1.
Figure 4:
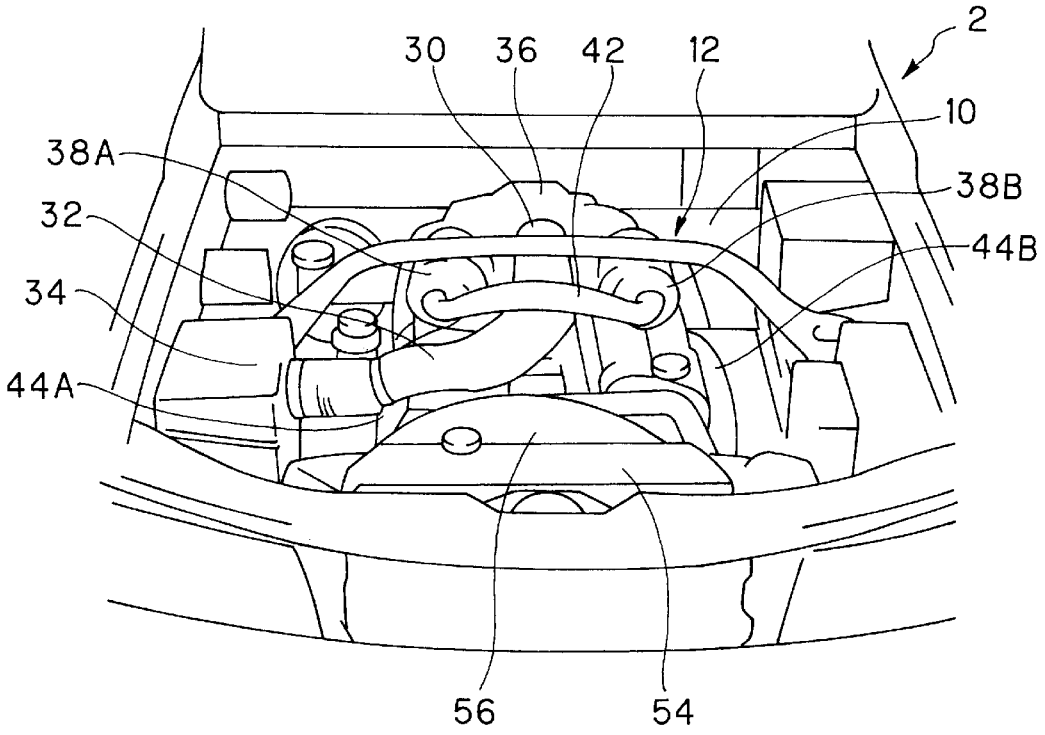
FIG. 4 is a perspective view of an engine compartment.
Figure 5:
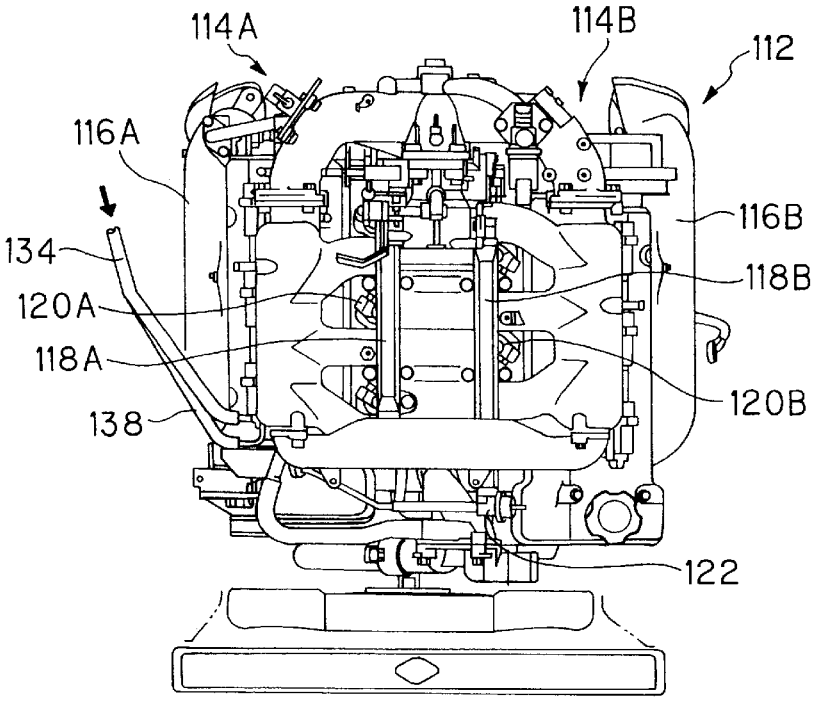
FIG. 5 (PRIOR ART)
FIG. 5 is a plan view of an engine showing a conventional fuel piping structure.
Figure 6:
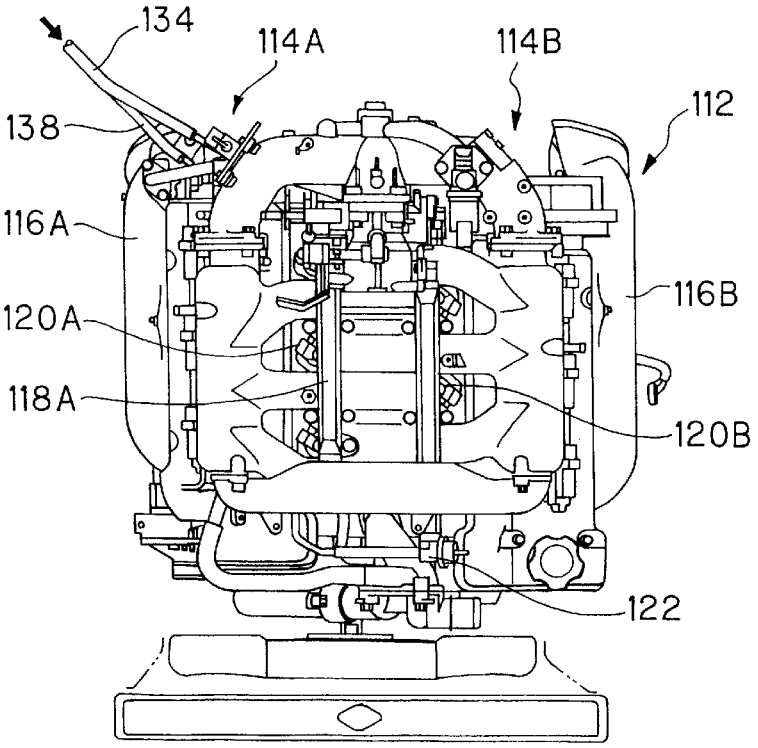
FIG. 6 (PRIOR ART)
FIG. 6 is a plan view of an engine showing another conventional fuel piping structure.
Figure 7:
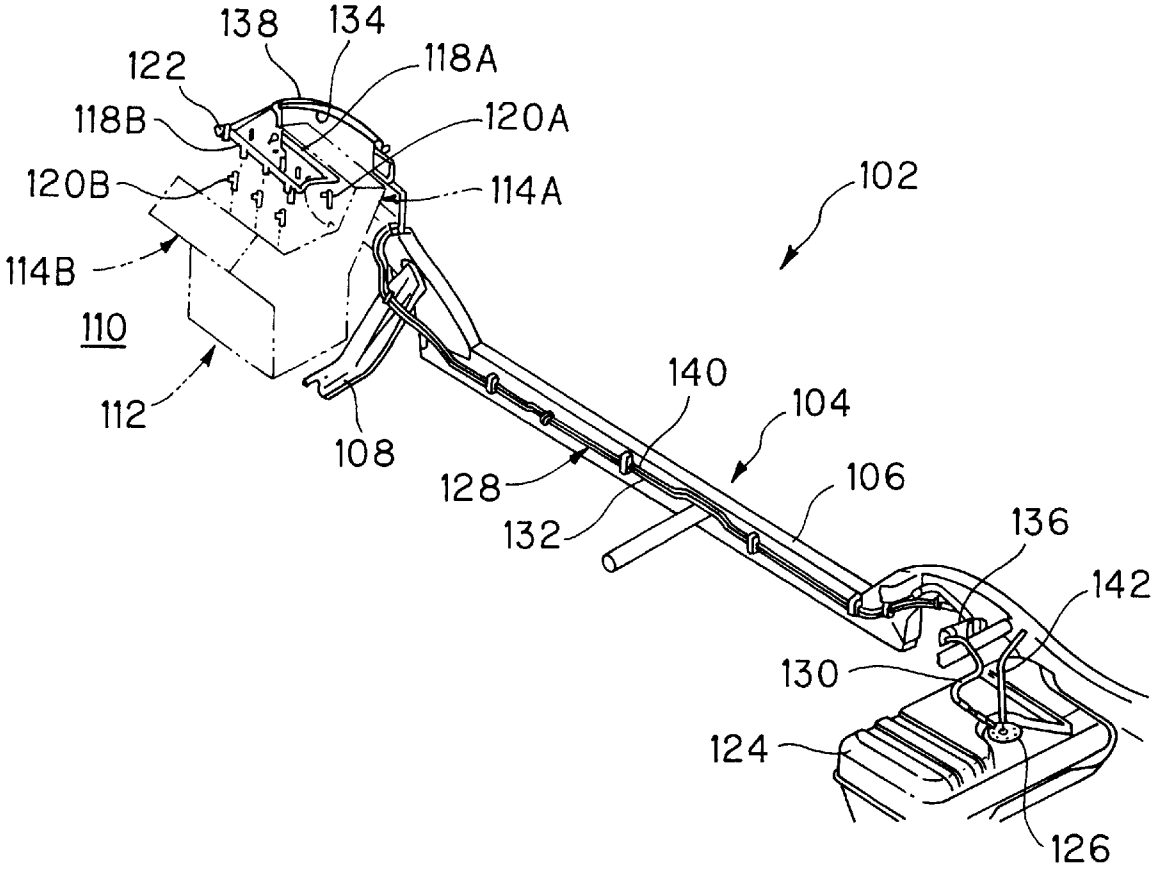
FIG. 7 (PRIOR ART)
FIG. 7 is a perspective view showing conventional fuel pipes running between the engine and the fuel tank.

As shown in FIG. 4, the vehicle 2 has an engine 12 mounted in the engine compartment 10 and oriented so that the lengthwise direction (i.e., the direction of the crankshaft axis) of the engine is aligned with the vehicular longitudinal direction (i.e., the direction of movement). In the engine 12, as shown in FIGS. 1 and 2, cylinder heads 16A and 16B are mounted on the left and right, respectively, of a generally V-shaped cylinder block 14, and head covers 18A and 18B are respectively mounted on the cylinder heads 16A and 16B. In this way cylinder banks 20A and 20B are arranged in a V shape.

In the engine 12, a bearing cap 22 is secured to the lower portion of the cylinder block 14 to support a rotatable crankshaft 24, and an oil pan 26 is attached to the lower portion of the bearing cap 22. A space 28 is formed between the cylinder banks 20A and 20B, which space 28 is positioned centrally relative to the transverse direction and extends longitudinally of the engine and the vehicle.

A throttle body 30 which constitutes part of an intake system is disposed above the space 28. As shown in FIG. 4, the throttle body 30 is connected to an air cleaner 34 through an intake duct 32. The throttle body 30 is connected through an intake distributing pipe 36 to the rear side of surge tank portions 38A and 38B which are on the left and right, respectively.

The surge tank portions 38A and 38B are respectively disposed above the head covers 18A and 18B of the cylinder banks 20A and 20B. One ends of intake manifolds 40A and 40B are respectively connected to the surge tank portions 38A and 38B, while the opposite ends of the intake manifolds 40A and 40B are connected to cylinders (not shown) associated with the cylinder heads 16A and 16B. The front sides of the surge tank portions 38A and 38B, in the vehicular longitudinal direction, are connected together through a connecting pipe 42.

In the engine 12, exhaust manifolds 44A and 44B are disposed on opposite sides of the engine in the transverse direction outside the respective cylinder heads 16A and 16B, and are spaced outwardly from the center space 28. On the other hand, fuel system components, delivery pipes 46A, 46B, fuel injection valves 48A, 48B and fuel pressure regulating valve 50 are disposed in the space 28.

In the engine 12, as shown in FIGS. 1 and 2, a cooling fan 52, which is driven directly by the engine 12, is provided on the front of the engine in the longitudinal direction. Radiator 54 and a fan shroud 56 are also located in front of the cooling fan 52. A coolant pipe 58 conducts hot coolant to radiator 54 from the engine 12, and a coolant pipe 60 returns the cooled coolant from radiator 54 to the engine. The coolant pipe 60 is located behind the fan within the airflow path of the fan, as shown in FIG. 2.

The vehicle 2 has a fuel tank 62 located at the rear of the vehicle 2 as shown in FIG. 3. The fuel tank 62 is provided with a fuel pump 64 for the supply of fuel to the engine 12. The engine 12 is connected to the fuel tank 62 through a fuel piping structure 66. The fuel pump 64 is connected to the delivery pipes 46A and 46B through a tank-side fuel supply hose 68, a fuel supply pipe 70 and an engine-side fuel supply hose 72 which are components of the fuel piping structure 66. The tank-side fuel supply hose 68 is provided a fuel filter 74 midway thereof.

Further, through an engine-side fuel return hose 76, a fuel return pipe 78 and a tank-side fuel return hose 80, which are also components of the fuel piping structure 66, the fuel pressure regulating valve 50 is connected to the fuel tank 62. The engine-side fuel supply hose 72 and the fuel return hose 76 are located in close proximity to the engine 12, and are positioned longitudinally between the exhaust manifold 44A and the cooling fan 52 as shown in FIGS. 1 and 2 to protect them from the heat of the exhaust manifold 44A. The engine-side fuel supply hose 72 and the fuel return hose 76 are thus located in such a manner as to be positioned within the airflow path discharged from the cooling fan 52, as shown in FIG. 2. The engine-side fuel supply hose 72 and fuel return hose 76 are constructed in part of metal. The metal parts are designated as metallic engine-side fuel supply pipe part 72S and engine-side fuel return pipe part 76S and are integral with the coolant piping 60 which is positioned between the exhaust manifold 44A and the cooling fan 52, as shown in FIG. 2, whereby these parts 72S and 76S are also positioned in the path of air discharged from the fan.

The operation of the fuel piping structure will now be briefly described.

In the engine compartment 10 of the vehicle 2, the engine 12 is mounted so that its longitudinal extend is oriented in the vehicular longitudinal direction. The cooling fan 52, which is driven directly by the engine 12, is disposed on the front side of the engine in the vehicular longitudinal direction, and the fuel piping 66 at the engine end thereof is located longitudinally between the exhaust manifold 44A and the cooling fan 52.

In the engine compartment 10, the unused space between exhaust manifold 44A and the cooling fan 52 can be utilized as a mounting space for the fuel piping structure of the longitudinally-oriented engine 12. Thus, an effective utilization of space can be attained and there is no interference with other parts. Further, the heat of the exhaust manifold 44A is transferred rearwardly of the engine 12 by the airflow from the cooling fan 52. This avoids the influence of exhaust manifold heat on the fuel piping 66 since the fuel piping 66 is mounted in front of the exhaust manifold 44A and then extends rearwardly through the center space defined between the banks of the V shape.

In the fuel piping structure 66, since the metallic engine-side fuel supply pipe 72S and fuel return pipe 76S are integral with the coolant piping 60 which is located between the exhaust manifold 44A and the cooling fan 52, the fuel can be cooled by heat exchange with the coolant which is flowing through the coolant piping 60. Further, since the fuel pipes 72S and 76S are positioned within the rearward airflow from the cooling fan 52, they can also be cooled by the airflow. The integral arrangement of pipes 72S and 76S with the coolant piping 60 also allows all of these to be simultaneously mounted on the engine.

Consequently, the fuel piping structure 66 is not thermally influenced by exhaust manifold 44A, whereby the fuel is prevented from becoming overheated. Moreover, by the integral arrangement of the fuel piping structure 66 with the coolant piping 60, it is possible to avoid the influence of heat on the fuel piping structure 66, reduce the number of mounting steps, improve the assembly and decrease the number of parts.

In the fuel piping structure as shown in FIG. 4, the fuel piping structure 66 positioned between exhaust manifold 44A and cooling fan 52 can be covered with the air intake duct 32 and the connecting pipe 42 or the like, thus contributing to an improvement in appearance.

Further, in the fuel piping structure 66 as shown in FIG. 3, the portion of the fuel piping 66 which runs between the side frame 4 and the engine 12 can be disposed on the lower side of the engine 12 which undergoes little relative displacement. Therefore, it is possible to diminish the play or relative movement of the fuel piping, and a reduction in cost can be attained by shortening the piping.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A fuel piping structure in an engine mounted in a longitudinal direction of an engine compartment of a vehicle, comprising a cooling fan driven directly by the engine and disposed spaced from a front side of the engine in the vehicular longitudinal direction for creating an air flow gap between said cooling fan and said front side of said engine, and a fuel pipe positioned in said air flow gap intermediate an exhaust component of the engine and said cooling fan, whereby air flow from said cooling fan flows directly over said fuel pipe.

2. A fuel piping structure according to claim 1, wherein said fuel pipe is integral with a coolant piping positioned longitudinally between said exhaust component of the engine and said cooling fan.

3. A fuel piping structure for an engine mounted in an engine compartment in a vehicle, said engine as mounted having a longitudinal axis aligned with a longitudinal direction of the vehicle, said engine having at least one exhaust manifold, comprising:

a cooling fan spaced from a front of said engine and connected to and driven by said engine;

a fuel supply pipe connected between a gas tank and said engine;

a fuel return pipe connected between said gas tank and said engine;

said fuel supply pipe and said fuel return pipe being disposed closely adjacent one another and running substantially colinearly between said gas tank and said engine, said fuel supply pipe and said return pipe each having a first pipe portion located in close proximity of the front of said engine and located in front of said exhaust manifold but behind said cooling fan so that airflow from said cooling fan cools said first pipe portions and prevents heating thereof by said exhaust manifold.

4. A fuel piping structure for an engine according to claim 3, wherein said first portions are oriented vertically on the front of said engine.

5. A fuel piping structure for an engine according to claim 3, wherein said first portions are fabricated of metal so as to improve heat transfer.

6. A fuel piping structure of an engine according to claim 3, wherein said first portions are constructed integrally with a coolant pipe which is positioned longitudinally between said cooling fan and the front of said engine.

7. A fuel piping structure for an engine according to claim 3, wherein said fuel supply pipe and said fuel return pipe each include an elongate portion which runs rearward from the engine along a longitudinally extending side frame element for connection with said gas tank.

8. A fuel piping structure for an engine mounted in an engine compartment in a vehicle, said engine as mounted having a longitudinal axis aligned with a longitudinal direction of the vehicle, said engine having at least one exhaust manifold, comprising:

a cooling fan spaced from a front of said engine and connected to and driven by said engine;

a fuel pipe structure connected between a gas tank and said engine, said fuel pipe structure having a first pipe portion located in proximity of the front of said engine and located in front of said exhaust manifold and behind said cooling fan so that airflow from said cooling fan cools said first pipe portion and prevents heating of said first pipe portion by said exhaust manifold.

9. A fuel piping structure for an engine according to claim 8, wherein said first pipe portion is fabricated of metal so as to improve heat transfer.

10. A fuel piping structure for an engine according to claim 8, wherein said first portion is constructed integrally with a coolant pipe which is positioned longitudinally between said cooling fan and the front of said engine.

11. A fuel piping structure according to claim 8, wherein said engine includes two sidewardly spaced cylinder banks in a V shape and defining a longitudinally extending center space therebetween, a said exhaust manifold being connected to an outer side of each said cylinder bank, and said fuel pipe structure including an elongate second pipe portion which joins to said first pipe portion and extends rearwardly of the vehicle through said center space.

12. A fuel piping structure according to claim 2, wherein said engine extends vertically from an oil pan toward an intake manifold, and at least a portion of said fuel pipe extends vertically through said airflow gap.

13. A fuel piping structure according to claim 11, wherein said engine extends vertically from an oil pan toward said center space, and said first pipe portion extends vertically between said cooling fan and the front side of said engine.

* * * * *